US009578723B2

(12) United States Patent
Sung et al.

(10) Patent No.: US 9,578,723 B2
(45) Date of Patent: Feb. 21, 2017

(54) LIGHTING CONTROL DEVICE AND METHOD

(71) Applicant: Electronics and Telecommunications Research Institute, Daejeon (KR)

(72) Inventors: Jung-Sik Sung, Daejeon (KR); Hyun-Chul Kang, Daejeon (KR); Hyun-Joo Kang, Daejeon (KR); Seong-Hee Park, Daejeon (KR); Jong-Woo Choi, Daejeon (KR); In-Su Kim, Daejeon (KR); Tae-Gyu Kang, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 65 days.

(21) Appl. No.: 14/631,665

(22) Filed: Feb. 25, 2015

(65) Prior Publication Data

US 2015/0245451 A1 Aug. 27, 2015

(30) Foreign Application Priority Data

Feb. 26, 2014 (KR) ..... 10-2014-0022450

(51) Int. Cl.
*H05B 37/02* (2006.01)

(52) U.S. Cl.
CPC ..... *H05B 37/0272* (2013.01); *H05B 37/0254* (2013.01)

(58) Field of Classification Search
CPC ..... H05B 37/0272; H05B 37/0254
See application file for complete search history.

(56) References Cited

U.S. PATENT DOCUMENTS

| | | | | |
|---|---|---|---|---|
| 2009/0212718 | A1* | 8/2009 | Kawashima | H05B 37/0218 315/297 |
| 2010/0135669 | A1 | 6/2010 | Kim et al. | |
| 2011/0184577 | A1* | 7/2011 | Ilyes | H05B 37/0272 700/295 |

FOREIGN PATENT DOCUMENTS

| | | | |
|---|---|---|---|
| KR | 10-2009-0093099 | A | 9/2009 |
| KR | 20090093099 | * | 9/2009 |

* cited by examiner

*Primary Examiner* — Douglas W Owens
*Assistant Examiner* — Jonathan Cooper

(57) ABSTRACT

A lighting control device and method are disclosed herein. The lighting control device includes a control unit and a control request unit. The control unit sets up a virtual multiple lighting control unit corresponding to a lighting control command received from a lighting management device. The control request unit selects a wireless light fixture corresponding to a light fixture ID included in the lighting control command, and makes a lighting control request to the selected wireless light fixture. The control unit transfers a response to the lighting control request to the lighting management device, and thus allows a corresponding lighting switch to control the wireless light fixture.

14 Claims, 4 Drawing Sheets

LIGHTING CONTROL DEVICE AND METHOD

CROSS-REFERENCE TO RELATED APPLICATION

This application claims the benefit of Korean Patent Application No. 10-2014-0022450, filed Feb. 26, 2014, which is hereby incorporated by reference herein in its entirety.

BACKGROUND

1. Technical Field

The present disclosure relates to a lighting control device and method and, more particularly, to a device and method that control a wireless light fixture using a virtual multiple terminal relay so that a master-slave bus type wired lighting network can accommodate a wireless lighting network.

2. Description of the Related Art

In order for a wired lighting network to accommodate a wireless lighting network, a specific configuration that is capable of performing the function of connecting wired communication with wireless communication like a gateway is required.

For example, Korean Patent Application Publication No. 10-2009-0093099 entitled "Wide-area Lighting System based on Wired/Wireless Communication" discloses technology that transfers control commands, generated by a lighting drive terminal, to a ZigBee gateway via a wired interface, performs protocol conversion using the ZigBee gateway, and controls light fixtures via ZigBee wireless communication.

As described above, technology, such as a gateway for supporting a basic wired interface for wired/wireless network lighting convergence, has been developed already.

However, there is a need for technology that is capable of, when a new light fixture is additionally installed or lighting layout is changed in an existing wired lighting network, integrating an easy-to-install wireless lighting network with the existing wired lighting network, which has not been developed yet.

SUMMARY

At least some embodiments of the present invention are directed to the provision of a device and method that control a wireless light fixture using a virtual multiple terminal relay so that a master-slave bus type wired lighting network can accommodate a wireless lighting network.

In accordance with an aspect of the present invention, there is provided a lighting control method, including receiving, by a lighting control device providing a virtual multiple lighting control unit function, a lighting control command from a lighting management device; searching for a wireless address corresponding to a light fixture ID included in the lighting control command; making a lighting control request to a wireless light fixture corresponding to the wireless address, and receiving a response to the lighting control request; and transferring the response to the lighting control request to the lighting management device, thereby allowing a corresponding lighting switch to control the wireless light fixture.

The lighting control method may further include, after searching for the wireless address, when there is no link connection with the wireless address, requesting a wireless link connection from the wireless light fixture, and receiving a corresponding response.

The lighting control method may further include, before receiving, by the lighting control device, the lighting control command from the lighting management device, when a user manipulates a button, transferring, by the lighting switch, an interrupt request signal indicating that the button corresponding to a specific light fixture ID has been manipulated to the lighting management device; and sequentially requesting, by the lighting management device, the state of the corresponding wireless light fixture from individual lighting switches using the light fixture ID included in the interrupt request signal.

Receiving the lighting control command may include receiving the lighting control command from the lighting management device from which the lighting control command request has been requested by a specific lighting switch.

The lighting control command may be at least one of the control commands to turn on and off, dim, and control the color and lighting scene of the corresponding wireless light fixture.

Receiving the response may include converting the lighting control command into a command in a protocol corresponding to a wireless network, making the lighting control request, corresponding to a result of the conversion, to the wireless light fixture, and receiving a response to the wireless lighting control request.

In accordance with another aspect of the present invention, there is provided a lighting control device, including a control unit configured to set up a virtual multiple lighting control unit corresponding to a lighting control command received from a lighting management device; and a control request unit configured to select a wireless light fixture corresponding to a light fixture ID included in the lighting control command and make a lighting control request to the selected wireless light fixture; wherein the control unit transfers a response to the lighting control request to the lighting management device, thereby allowing a corresponding lighting switch to control the wireless light fixture.

The lighting control device may further include a protocol conversion unit configured to convert the lighting control request into a request in a protocol corresponding to a wireless network.

The lighting control command may be at least one of the control commands to turn on and off, dim, and control the color and lighting scene of the corresponding wireless light fixture.

The lighting control device may further include an address management unit configured to manage the address of the wireless light fixture corresponding to the light fixture ID using a wireless address mapping table.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
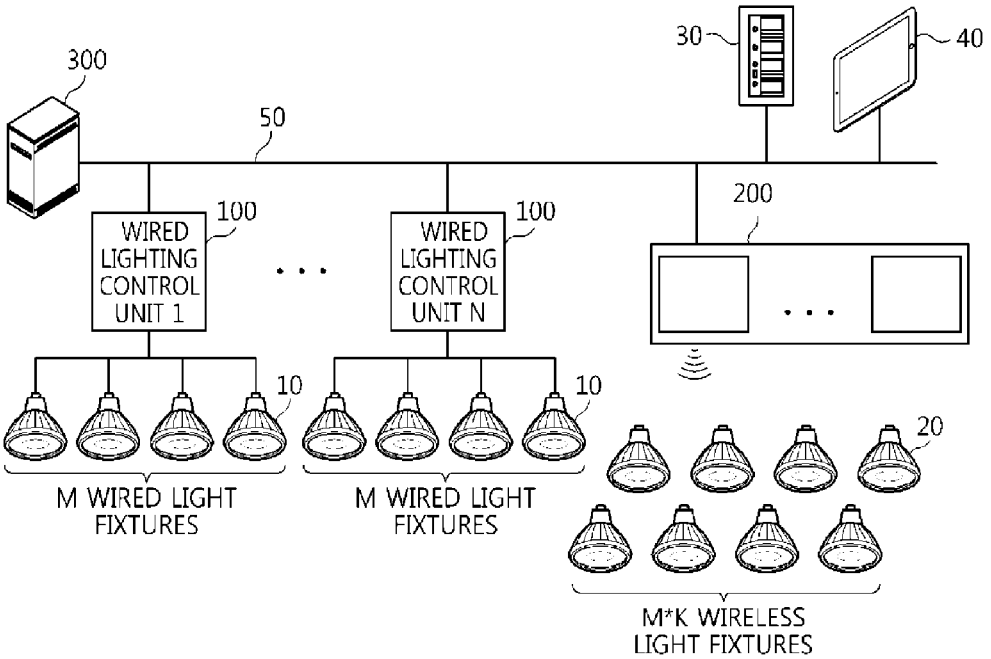
FIG. 1 is a diagram illustrating an environment to which a lighting control device for controlling a wireless light fixture using a virtual multiple terminal relay so that a master-slave bus type wired lighting network can accommodate a wireless lighting network according to an embodiment of the present invention is applied.

Embodiments of the present invention will be described in detail below with reference to the accompanying drawings. Repeated descriptions and descriptions of well-known functions and configurations that have been deemed to make the gist of the present invention unnecessarily obscure will be omitted below. The embodiments of the present invention are intended to fully describe the present invention to persons having ordinary knowledge in the art to which the present invention pertains. Accordingly, the shapes, sizes, etc. of components in the drawings may be exaggerated to make the description obvious.

A lighting control device and method according to embodiments of the present invention are described in detail below with reference to the accompanying drawings.

FIG. 1 is a diagram illustrating an environment to which a lighting control device for controlling a wireless light fixture using a virtual multiple terminal relay so that a master-slave bus type wired lighting network can accommodate a wireless lighting network according to an embodiment of the present invention is applied.

First, an existing bus-based wired lighting network includes a lighting management device 300, a lighting switch 30 or a touchpad lighting switch 40, wired lighting control units 100, and wired light fixtures 10 that are actually controlled.

In the bus-based wired lighting network, the lighting management device 300 acts as a master, and the remaining components act as slaves to which control request commands can be transferred by the master device.

In the bus-based wired lighting network, when a user manipulates a button using the lighting switch 30, an interrupt request (IRQ) signal is transferred to the lighting management device 300, and the lighting management device 300 having received the interrupt request signal sequentially queries individual lighting switches about whether each of the lighting switches has a control requirement. In this case, all the lighting switches, except the lighting switch 30 used by the user to manipulate a button, make no response, and only the lighting switch 30 transfers a control request command to the lighting management device 300.

Then the lighting management device 300 transfers a control command to control the corresponding wired light fixture 10 of the wired lighting control unit 100 mapped to the lighting switch 30, and receives the result of performance corresponding to a control command, i.e., the state of the corresponding wired light fixture 10. Furthermore, the lighting management device 300 transfers the state of the corresponding wired light fixture 10 to the lighting switch 30. A single wired lighting control unit 100 can usually control four wired light fixtures 10.

It is desirable to connect the above-described bus-based wired lighting network to one or more new light fixtures 20 in a wireless manner without requiring expensive additional wired equipment and then control the newly connected wireless light fixtures 20 without a difference between the wired and wireless light fixtures using the existing lighting management device 300 and the existing lighting switch 30.

For this purpose, the present invention proposes a lighting control device 200 that is capable of accommodating a maximum of 256 (M*K) wireless light fixtures 20 while acting as an existing wired lighting control unit 100.

Next, the lighting control device 200 is described in detail with reference to FIG. 2.

Figure 2:
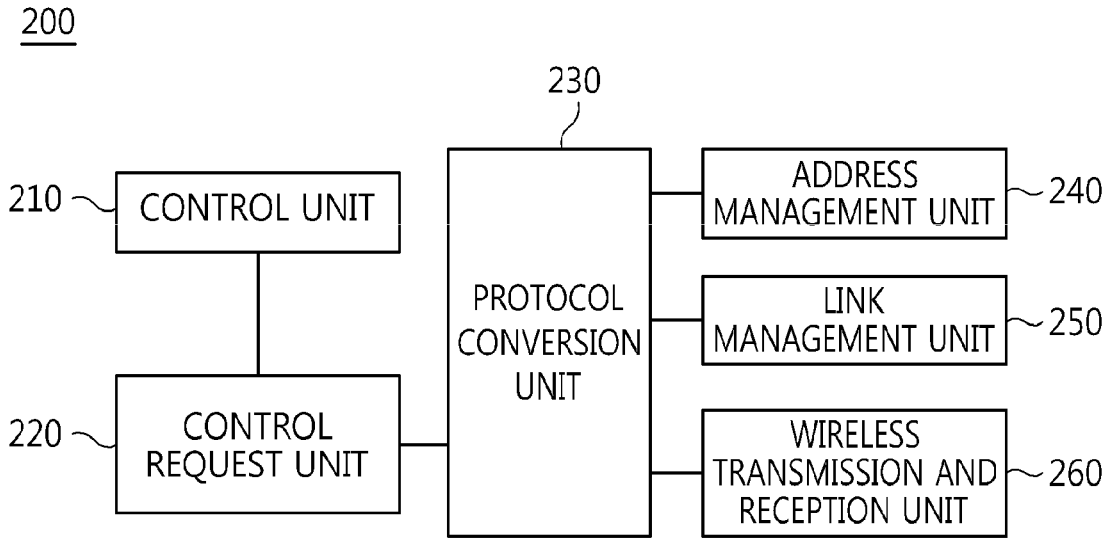
FIG. 2 is a configuration diagram schematically illustrating a lighting control device according to an embodiment of the present invention.

FIG. 2 is a configuration diagram schematically illustrating a lighting control device according to an embodiment of the present invention.

Referring to FIG. 2, the lighting control device 200 includes a control unit 210, a control request unit 220, a protocol conversion unit 230, an address management unit 240, a link management unit 250, and a wireless transmission and reception unit 260.

The control unit 210 is a block responsible for the function of a virtual multiple lighting control unit. The control unit 210 supports the lighting management device 300 so that the lighting management device 300 can control a maximum of 256 wireless light fixtures using the single lighting control device 200, and also supports the effect of being as if there was a plurality of wired lighting control units 100.

The control request unit 220 selects a wireless light fixture corresponding to a light fixture ID received from the control unit 210, and transfers a control command to control the select wireless light fixture to the protocol conversion unit 230. In this case, the control request unit 220 searches the address management unit 240 for the address of the wireless light fixture corresponding to the light fixture ID.

The protocol conversion unit 230 acquires the address of the wireless light fixture corresponding to the light fixture ID from the address management unit 240, and performs control in order to set up a wireless link using the link management unit 250 if a session has not been connected to the acquired address of the wireless light fixture.

The protocol conversion unit 230 converts a control command received from the control request unit 220 into a command in a protocol corresponding to a wireless network, and transmits the result of the conversion to the corresponding wireless light fixture via the wireless transmission and reception unit 260.

The address management unit 240 manages the addresses of wireless light fixtures corresponding to light fixture IDs using a wireless address mapping table (not illustrated).

The wireless transmission and reception unit 260 transmits the result obtained by the protocol conversion unit 230 to the corresponding wireless light fixture, and receives a corresponding response.

Next, a method in which the lighting control device 200 controls wireless light fixtures individually or in groups so that a master-slave bus type wired lighting network can accommodate a wireless lighting network is described in detail with reference to FIG. 3.

Figure 3:
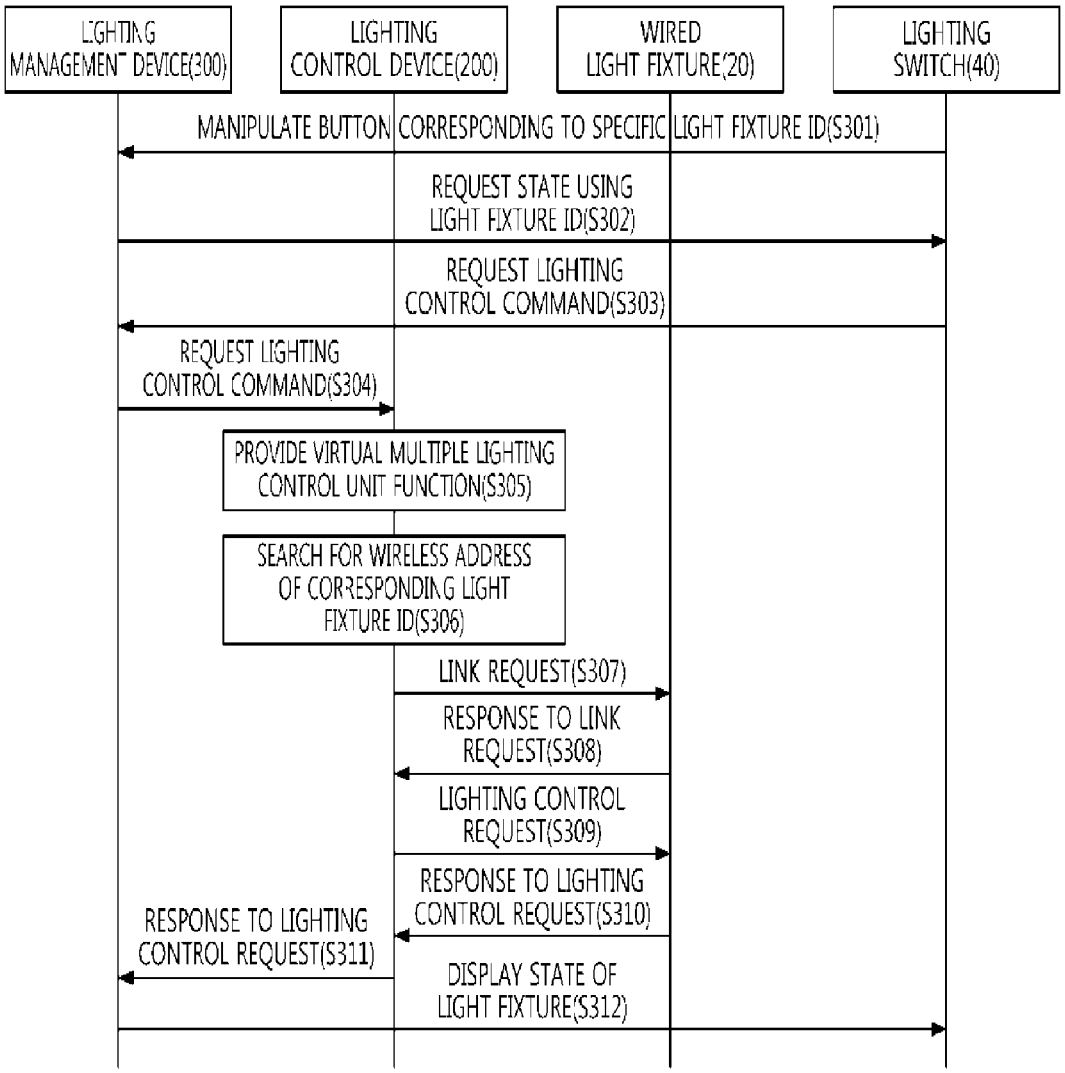
FIG. 3 is a flowchart of a lighting control method according to an embodiment of the present invention.

FIG. 3 is a flowchart of a lighting control method according to an embodiment of the present invention.

Referring to FIG. 3, in an environment to which the lighting control device 200 according to an embodiment of the present invention controls lighting, a lighting management device 300, a wireless light fixture 20, and a lighting switch 40 are located. In this case, although the wireless light fixture 20 is illustrated as being one in number, the wireless light fixture 20 may include a plurality of wireless light fixtures.

A user manipulates the button of the lighting switch 40 corresponding to a wireless light fixture that the user desires to control.

When the user manipulates the button, the lighting switch 40 transfers an IRQ signal indicating that the button of the specific light fixture ID (light fixture ID) has been manipulated to the lighting management device 300 at step S301.

The lighting management device 300 sequentially requests the state of the corresponding wireless light fixture from individual lighting switches using the light fixture ID included in the interrupt request signal at step S302.

All the lighting switches having received the request at step S302, except the lighting switch 40 whose button was manipulated by the user, do not make a response, and the lighting switch 40 requests a lighting control command to control the corresponding wireless light fixture 20 from the lighting management device 300 at step S303. In this case, the lighting control command may be at least one of the control commands to turn on and off, dim, and control the color and lighting scene of the corresponding wireless light fixture.

The lighting management device 300 transfers the lighting control command, received at step S303, to the lighting control device 200 corresponding to the light fixture ID included in the interrupt request signal at step S304. In this case, the light fixture ID has been mapped to the corresponding lighting control device 200 in advance.

The lighting control device 200 from which the lighting control command was requested provides a virtual multiple lighting control unit function, thereby setting up the function of supporting k lighting control devices at step S305.

The lighting control device 200 searches for the address of the wireless light fixture (hereinafter the "wireless address") corresponding to the light fixture ID using the light fixture ID and a wireless address mapping table (not illustrated) at step S306.

When there is no link connection with the wireless address found at step S306, the lighting control device 200 requests a wireless link connection with the wireless light fixture 20 at step S307, and receives a corresponding response at step S308.

Thereafter, when a wireless session is connected, the lighting control device 200 converts a control command into a command in a protocol corresponding to a wireless network, and transfers the result of the conversion, i.e., a lighting control request, to the wireless light fixture 20 at step S309. Furthermore, the lighting control device 200 receives a response corresponding to the lighting control request from the wireless light fixture 20 at step S310.

The lighting control device 200 transfers a response, corresponding to the corresponding lighting control request received via the corresponding lighting control unit at step S310, to the lighting management device 300 using the virtual multiple lighting control unit function at step S311.

The lighting management device 300 determines the state of the light fixture based on the response corresponding to the lighting control request received at step S311, and transfers the state of the light fixture to the lighting switch 30 at step S312, thereby allowing the lighting switch 30 to be aware of the state of the light fixture.

Figure 4:
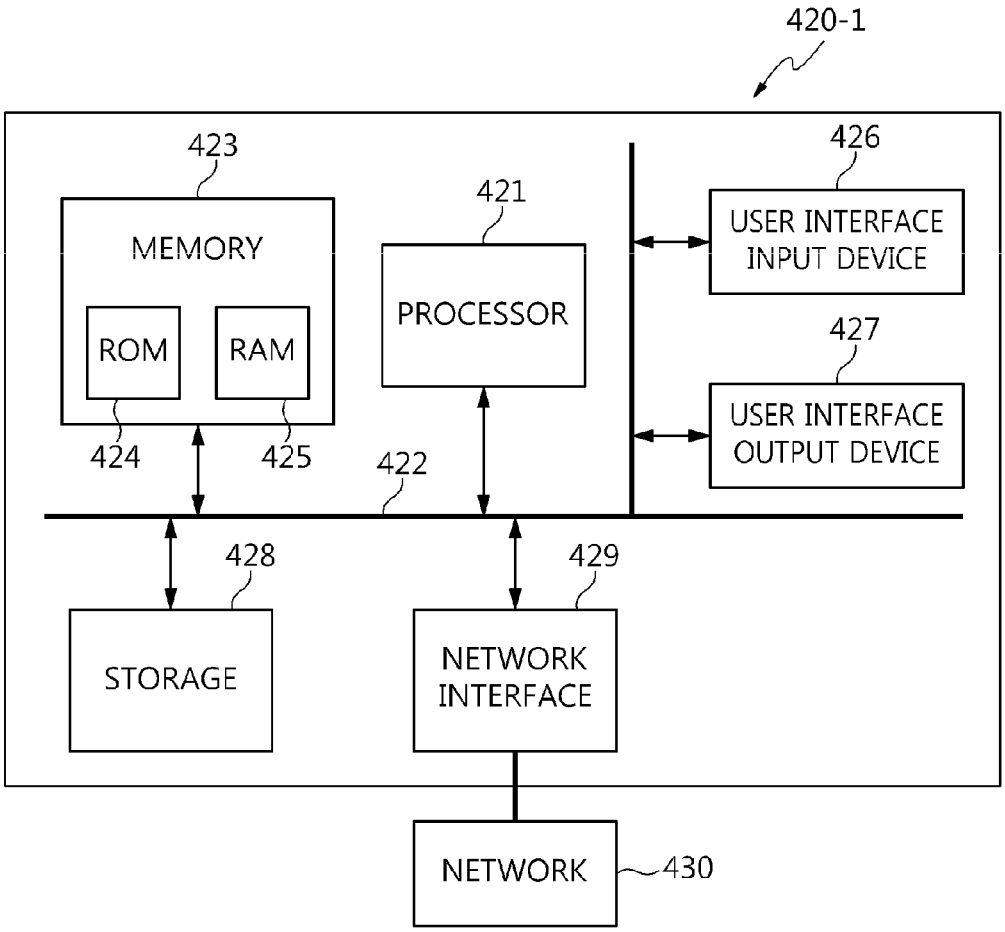
FIG. 4 is an embodiment of the present invention implemented in a computer system.

FIG. 4 is an embodiment of the present invention implemented in a computer system.

Referring to FIG. 4, an embodiment of the present invention may be implemented in a computer system, e.g., as a computer readable medium. As shown in in FIG. 4, a computer system 420-1 may include one or more of a processor 421, a memory 423, a user input device 426, a user output device 427, and a storage 428, each of which communicates through a bus 422. The computer system 420-1 may also include a network interface 429 that is coupled to a network 430. The processor 421 may be a central processing unit (CPU) or a semiconductor device that executes processing instructions stored in the memory 423 and/or the storage 428. The memory 423 and the storage 428 may include various forms of volatile or non-volatile storage media. For example, the memory may include a read-only memory (ROM) 424 and a random access memory (RAM) 425.

Accordingly, an embodiment of the invention may be implemented as a computer implemented method or as a non-transitory computer readable medium with computer executable instructions stored thereon. In an embodiment, when executed by the processor, the computer readable instructions may perform a method according to at least one aspect of the invention.

As described above, the present invention provides technology that is capable of, when a new light fixture is additionally installed or lighting layout is changed in an existing wired lighting network, integrating an easy-to-install wireless lighting network with the existing wired lighting network.

Furthermore, the single wireless lighting control device according to an embodiment of the present invention supports a virtual multiple wired lighting control unit, and thus it is possible to control a wireless light fixture using the existing lighting switch.

As described above, the optimum embodiments have been disclosed in the drawings and the specification. Although specific terms have been used herein, they have been used merely for the purpose of describing the present invention, but have not been used to restrict their meanings or limit the scope of the present invention set forth in the claims. Accordingly, it will be understood by those having ordinary knowledge in the relevant technical field that various modifications and other equivalent embodiments can be made. Therefore, the true ranges of protection of the present invention should be defined based on the technical spirit of the attached claims.

What is claimed is:

1. A lighting control method, comprising:

receiving, by a lighting control device providing a virtual multiple lighting control unit function, a lighting control command from a lighting management device;

searching for a wireless address corresponding to a light fixture ID included in the lighting control command;

after searching for the wireless address, requesting a wireless link from a wireless light fixture when there is no link connection with the wireless address, and receiving a corresponding response;

making a lighting control request to the wireless light fixture corresponding to the wireless address, and receiving a response to the lighting control request; and transferring the response to the lighting control request to the lighting management device, thereby allowing a corresponding lighting switch to control the wireless light fixture.

2. The lighting control method of claim 1, further comprising, before receiving, by the lighting control device, the lighting control command from the lighting management device:

when a user manipulates a button, transferring, by the lighting switch, an interrupt request signal indicating that the button corresponding to a specific light fixture ID has been manipulated to the lighting management device; and sequentially requesting, by the lighting management device, a state of the corresponding wireless light fixture from individual lighting switches using the light fixture ID included in the interrupt request signal.

3. The lighting control method of claim 1, wherein receiving the lighting control command comprises receiving the lighting control command from the lighting management device from which the lighting control command request has been requested by a specific lighting switch.

4. The lighting control method of claim 1, wherein the lighting control command is at least one of control commands to turn on and off, dim, and control a color and lighting scene of the corresponding wireless light fixture.

5. The lighting control method of claim 1, wherein receiving the response comprises:

converting the lighting control command into a command in a protocol corresponding to a wireless network, making the lighting control request, corresponding to a result of the conversion, to the wireless light fixture, and receiving a response to the wireless lighting control request.

6. A lighting control device, comprising:

a control unit configured to set up a virtual multiple lighting control unit corresponding to a lighting control command received from a lighting management device; and a control request unit configured to select a wireless light fixture corresponding to a light fixture ID included in the lighting control command and make a lighting control request to the selected wireless light fixture; and a wireless transmission and reception unit configured to transmit a request for a wireless link connection with the wireless light fixture when there is no link connection with a wireless address corresponding to the light fixture ID, and receive a corresponding response;

wherein the control unit transfers a response to the lighting control request to the lighting management device, thereby allowing a corresponding lighting switch to control the wireless light fixture.

7. The lighting control device of claim 6, further comprising:

a protocol conversion unit configured to convert the lighting control request into a request in a protocol corresponding to a wireless network.

8. The lighting control device of claim 6, wherein the lighting control command is at least one of control commands to turn on and off, dim, and control a color and lighting scene of the corresponding wireless light fixture.

9. The lighting control device of claim 6, further comprising:

an address management unit configured to manage an address of the wireless light fixture corresponding to the light fixture ID using a wireless address mapping table.

10. A lighting control method, comprising:

receiving, by a lighting control device providing a virtual multiple lighting control unit function, a lighting control command from a lighting management device;

searching for a wireless address corresponding to a light fixture ID included in the lighting control command;

making a lighting control request to a wireless light fixture corresponding to the wireless address, and receiving a response to the lighting control request; and transferring the response to the lighting control request to the lighting management device, thereby allowing a corresponding lighting switch to control the wireless light fixture, wherein before receiving the lighting control command from the lighting management device, the lighting switch transfers, when a user manipulates a button, an interrupt request signal indicating that the button corresponding to a specific light fixture ID has been manipulated to the lighting management device, and the lighting management device sequentially requests a state of the corresponding wireless light fixture from individual lighting switches using the light fixture ID included in the interrupt request signal.

11. The lighting control method of claim 10, further comprising, after searching for the wireless address:

when there is no link connection with the wireless address, requesting a wireless link connection from the wireless light fixture, and receiving a corresponding response.

12. The lighting control method of claim 10, wherein receiving the lighting control command comprises receiving the lighting control command from the lighting management device from which the lighting control command request has been requested by a specific lighting switch.

13. The lighting control method of claim 10, wherein the lighting control command is at least one of control commands to turn on and off, dim, and control a color and lighting scene of the corresponding wireless light fixture.

14. The lighting control method of claim 10, wherein receiving the response comprises:

converting the lighting control command into a command in a protocol corresponding to a wireless network, making the lighting control request, corresponding to a result of the conversion, to the wireless light fixture, and receiving a response to the wireless lighting control request.

* * * * *